US007278488B2

(12) United States Patent
Leduc

(10) Patent No.: US 7,278,488 B2
(45) Date of Patent: Oct. 9, 2007

(54) METHOD OF GENERATING STABLE FOAM FOR OIL AND GAS WELL CLEANOUTS

(76) Inventor: Al Leduc, 166-52065 RR210, Sherwood Park, AB (CA) T8G 1A1

( * ) Notice: Subject to any disclaimer, the term of this patent is extended or adjusted under 35 U.S.C. 154(b) by 0 days.

(21) Appl. No.: 11/683,395

(22) Filed: Mar. 7, 2007

(65) Prior Publication Data

US 2007/0144742 A1 Jun. 28, 2007

Related U.S. Application Data

(63) Continuation of application No. PCT/CA2005/001294, filed on Aug. 29, 2005.

(30) Foreign Application Priority Data

Sep. 10, 2004 (CA) ..... 2481533

(51) Int. Cl.
*E21B 21/14* (2006.01)
*E21B 37/06* (2006.01)

(52) U.S. Cl. ..... 166/312; 166/304; 166/309

(58) Field of Classification Search ..... None
See application file for complete search history.

(56) References Cited

U.S. PATENT DOCUMENTS 2,125,245 A 7/1938 McCray
3,377,139 A 4/1968 MacGregor
3,662,828 A 5/1972 Hutchison (Continued)

FOREIGN PATENT DOCUMENTS

GB 1248355 9/1971

*Primary Examiner*—Zakiya W. Bates
(74) *Attorney, Agent, or Firm*—Christensen O'Connor Johnson Kindness PLLC

(57) ABSTRACT

A method of foam emulsion well cleanout for gas well. An emulsifier apparatus is provided having a compressed air inlet, a foaming solution inlet and a foam outlet. The compressed air inlet is connected to a source of compressed air capable of supplying compressed air to the emulsifier apparatus within a range of selected pressures. The foaming solution is connected to a source of foaming solution capable of supplying foaming solution to the emulsifier apparatus within a range of selected pressures. The foam outlet is connected to a discharge conduit supplying foam to a gas well. The production of foam is initiated out of the foam outlet of the emulsifier apparatus by supplying compressed air to the emulsifier apparatus through the compressed air inlet at a rate of approximately 300 to 400 c.f.m. and at pressures within a range of 175 p.s.i and 375 p.s.i. and foaming solution is supplied to the emulsifier apparatus through the foaming solution inlet at a rate of approximately 10 to 15 liters per minute and at pressures sufficient to overcome internal pressure within the emulsifier apparatus caused by the inflow of compressed air through the compressed air inlet. The pressure of compressed air supplied to the emulsifier apparatus through the compressed air inlet is increased with a corresponding increase in the pressure of foaming solution supplied to the foaming solution inlet until sufficient pressure is generated to force foam exiting the foam outlet along the discharge conduit and down the gas well with an average density of approximately 1 KPA per meter, while monitoring gas well pressure and varying compressed air pressure and foam density to ensure that pressure is always maintained at less than 80% of well pressure.

3 Claims, 3 Drawing Sheets

U.S. PATENT DOCUMENTS 3,863,717 A * 2/1975 Cooper ..... 166/279
4,213,936 A 7/1980 Lodrick
4,394,289 A 7/1983 Brown
4,869,849 A 9/1989 Hirose
4,913,237 A 4/1990 Kutas
5,356,565 A 10/1994 Southwell
6,125,761 A * 10/2000 Smith et al. ..... 102/313
6,217,009 B1 4/2001 Rowe
6,422,734 B1 7/2002 Sethuraman

* cited by examiner

METHOD OF GENERATING STABLE FOAM FOR OIL AND GAS WELL CLEANOUTS

FIELD OF THE INVENTION

The present invention relates to a method of well cleanout for a gas well, which uses a foam emulsion as the cleaning medium.

BACKGROUND OF THE INVENTION

All petroleum producing wells drilled in sand formations, eventually become clogged by sand. Foam emulsion well cleanout equipment and procedures were developed for use in oil wells and are not suited for use with gas wells. Oil, particularly heavy oil, can be more than 1000 times the weight of natural gas. The pressure and volume of foam emulsion needed for effective cleaning of an oil well, would hinder rather than aid in the production of natural gas.

All attempts to adapt oil well foam emulsion cleanout methods to gas wells have, to date, proven unsuccessful. There have been so many instances of gas wells being damaged, that the industry is presently pre-mixing foam in tanks and then injecting the foam into the well under carefully controlled pressures. Working with pre-mixed foam does not permit the crew servicing the gas well to react rapidly to changes in pressure by increasing or decreasing the density of the foam.

SUMMARY OF THE INVENTION

What is required is a method of foam emulsion well cleanout for a gas well that will permit an immediate increasing or decreasing of the density of the foam in response to changes in pressure.

According to the present invention there is provided a method of foam emulsion well cleanout for gas well. An emulsifier apparatus is provided having a compressed air inlet, a foaming solution inlet and a foam outlet. The compressed air inlet is connected to a source of compressed air capable of supplying compressed air to the emulsifier apparatus within a range of selected pressures. The foaming solution is connected to a source of foaming solution capable of supplying foaming solution to the emulsifier apparatus within a range of selected pressures. The foam outlet is connected to a discharge conduit supplying foam to a gas well. The production of foam is initiated out of the foam outlet of the emulsifier apparatus by supplying compressed air to the emulsifier apparatus through the compressed air inlet at a rate of approximately 300 to 400 c.f.m. and at pressures within a range of 175 p.s.i and 375 p.s.i. and foaming solution is supplied to the emulsifier apparatus through the foaming solution inlet at a rate of approximately 10 to 15 liters per minute and at pressures sufficient to overcome internal pressure within the emulsifier apparatus caused by the inflow of compressed air through the compressed air inlet. The pressure of compressed air supplied to the emulsifier apparatus through the compressed air inlet is increased with a corresponding increase in the pressure of foaming solution supplied to the foaming solution inlet until sufficient pressure is generated to force foam exiting the foam outlet along the discharge conduit and down the gas well with an average density of approximately 1 KPA per meter, while monitoring gas well pressure and varying compressed air pressure and foam density to ensure that pressure is always maintained at less than 80% of well pressure.

Other advantages will be apparent from the description below.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The preferred embodiment, a method of foam emulsion well cleanout for gas will now be described with reference to FIGS. 1 and 2.

Figure 1:
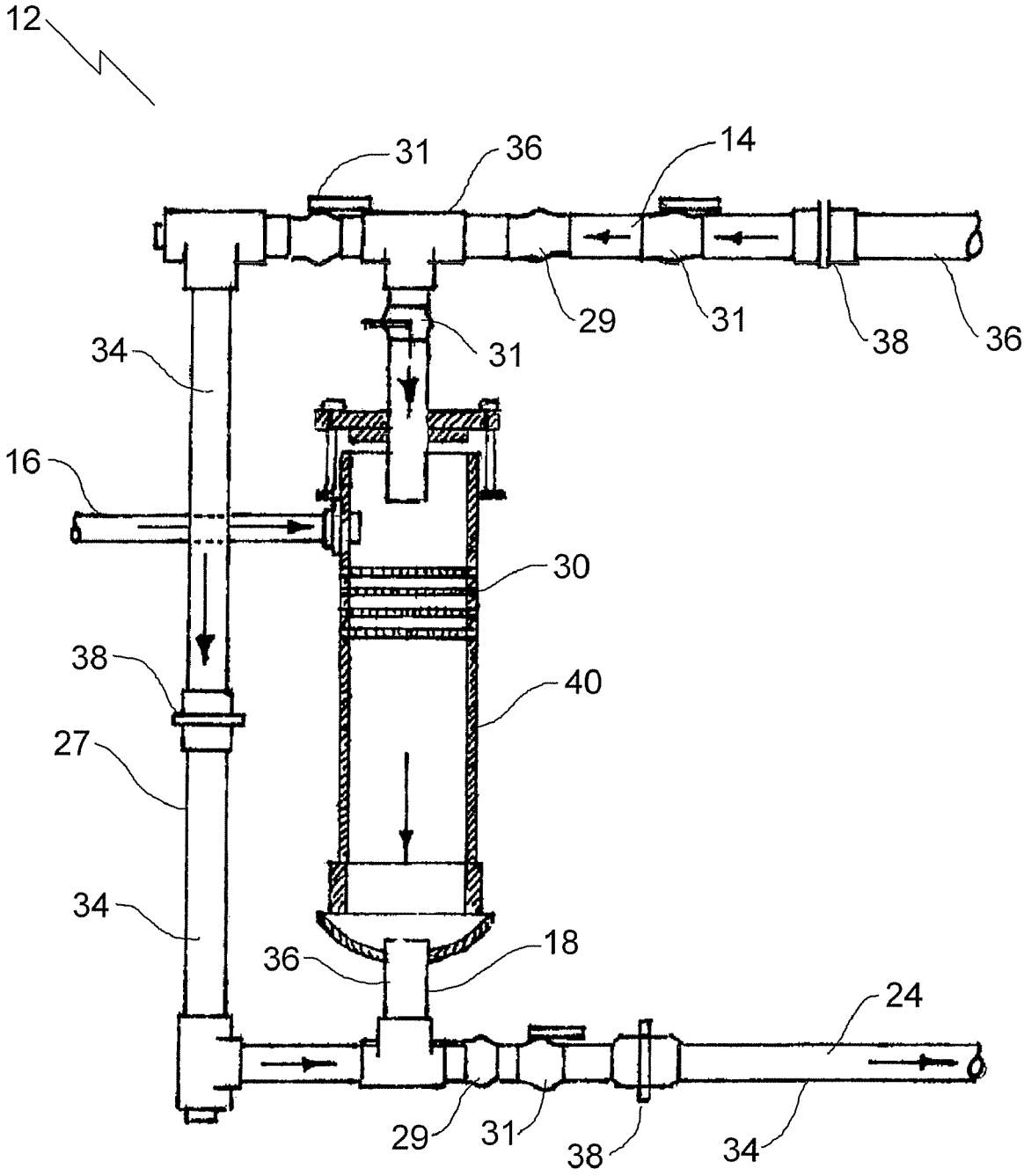
FIG. 1 is a side view in section of the emulsifier apparatus constructed in accordance with the teachings of the present invention.
Figure 2:
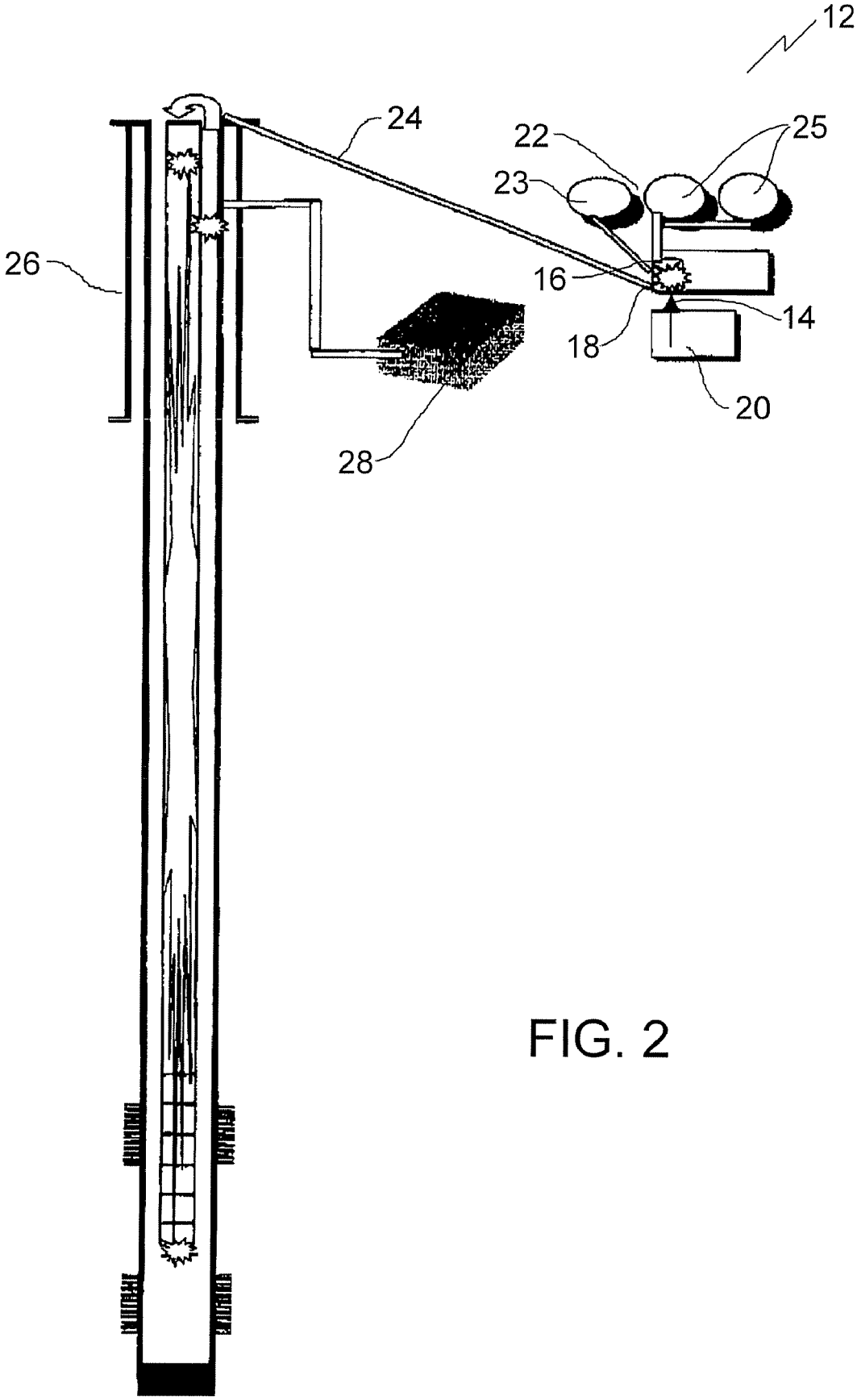
FIG. 2 is a side plan view of the emulsifier apparatus of FIG. 1 connected to a well.

Referring now to FIG. 1, there is shown an emulsifier apparatus 12 having a compressed air inlet 14, a foaming solution inlet 16 and a foam outlet 18. Referring to FIG. 2, compressed air inlet 14 is connected to a source of compressed air 20 capable of supplying compressed air to emulsifier apparatus 12 within a range of selected pressures. Foaming solution inlet 16 is connected to a source of foaming solution capable of supplying foaming solution to emulsifier apparatus 12 within a range of selected pressures. As shown in FIG. 2, source of foaming solution 22 may comprise multiple tank 23 and 25. As depicted, tank 23 is used to hold the foaming agent and tanks 25 are used to hold water necessary for mixing on site to form the foaming solution. Foam outlet 18 is connected to a discharge conduit 24 supplying foam to a gas well 26. Referring again to FIG. 1, a bypass line 27 may be included for the compressed air, in order to provide an option of using compressed air on the gas well without foam. A series of control valves 29 and ball valves 31 allow the user to control the flow of compressed air, foam, and foaming solution through emulsifier apparatus 12. In addition, some sections of the piping are flex piping 34 and others are rigid piping 36 to improve the operation. The various sections are joined by unions 38. Once the above connections are made, the production of foam is initiated out of foam outlet 18 of emulsifier apparatus 12 by supplying compressed air to emulsifier apparatus 12 through compressed air inlet 14 at a rate of approximately 300 to 400 c.f.m. and at pressures within a range of 175 p.s.i and 375 p.s.i. At the same time, foaming solution is supplied to emulsifier apparatus 12 through foaming solution inlet 16 at a rate of approximately 10 to 15 liters per minute and at pressures sufficient to overcome internal pressure within emulsifier apparatus 12 caused by the inflow of compressed air through the compressed air inlet 14. Referring to FIG. 2, the pressure of compressed air supplied to emulsifier apparatus 12 through compressed air inlet 14 is increased with a corresponding increase in the pressure of foaming solution supplied to foaming solution inlet 16. This is done until sufficient pressure is generated to force foam exiting foam outlet 18 along discharge conduit 24 and down gas well 26 with an average density of approximately 1 KPA per meter. The gas well pressure is monitored while this happens and the compressed air pressure and foam density are varied to ensure that pressure is always maintained at less than 80% of well pressure. A return tank 28 may also be included to capture the foam after being used in gas well 26.

Figure 3:
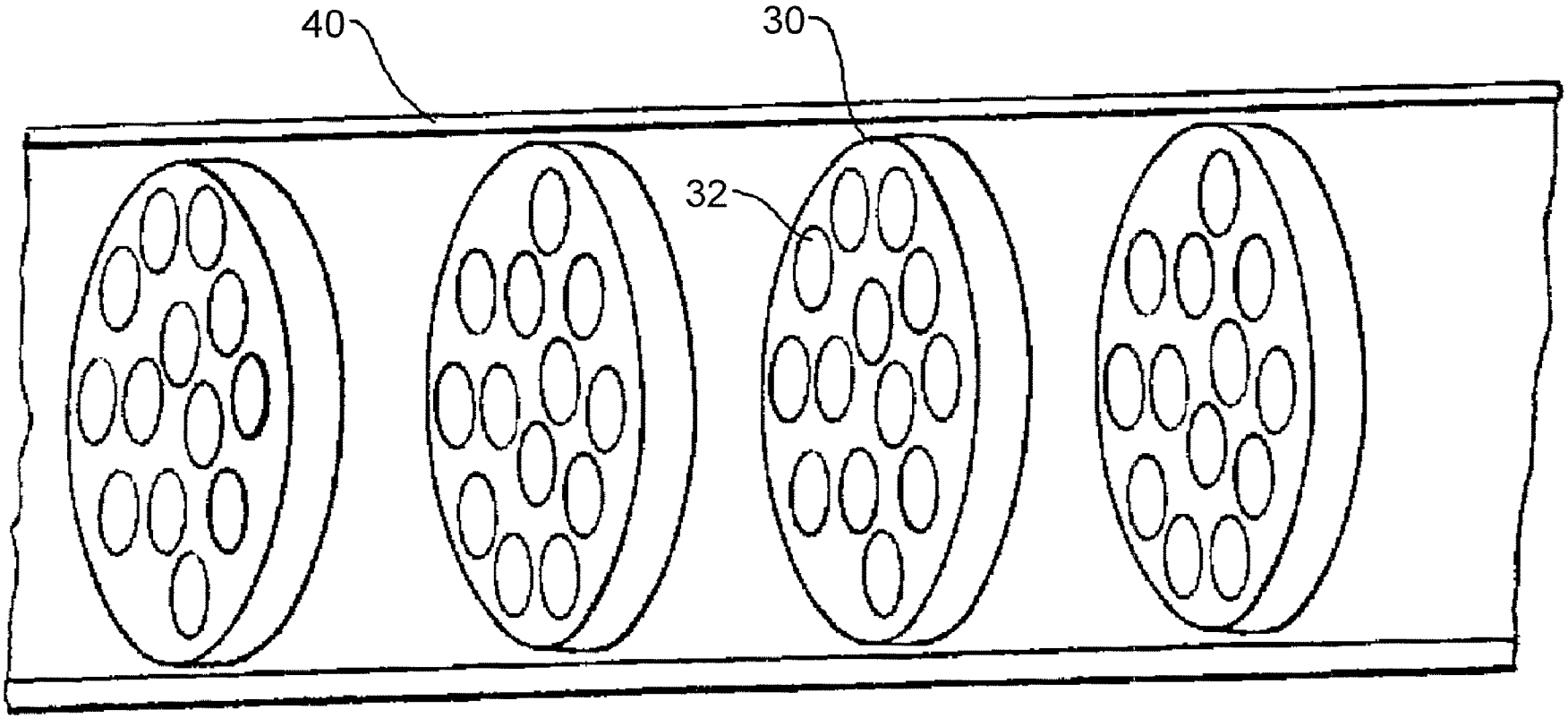
FIG. 3 is a perspective view in section of the mixing chamber.

Referring to FIG. 3 while different designs may be possible, it is preferable that emulsifier apparatus 12 have a series of axially spaced mixing plates 30 having holes 32. Holes 32 in adjacent mixing plates 30 are axially offset to improve emulsification. Plates 30 are held in a casing 40. It is also preferable that emulsifier apparatus 12 operates without the application of heat. It will be understood that the size of the holes and the number of holes plays a role in avoiding shear degradation of the foam.

It has been found that a plate diameter of about 12.7 cm with approximately 60 holes having a diameter of about 1.3 cm each is sufficient for the pressures being used to avoid shear degradation.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of foam emulsion well cleanout for gas well, comprising the steps of:

providing an emulsifier apparatus having a compressed air inlet, a foaming solution inlet and a foam outlet;

connecting the compressed air inlet to a source of compressed air capable of supplying compressed air to the emulsifier apparatus within a range of selected pressures;

connecting the foaming solution to a source of foaming solution capable of supplying foaming solution to the emulsifier apparatus within a range of selected pressures;

connecting the foam outlet to a discharge conduit supplying foam to a gas well;

initiating the production of foam out of the foam outlet of the emulsifier apparatus by supplying compressed air to the emulsifier apparatus through the compressed air inlet at a rate of approximately 300 to 400 c.f.m. and at pressures within a range of 175 p.s.i and 375 p.s.i. and supplying foaming solution to the emulsifier apparatus through the foaming solution inlet at a rate of approximately 10 to 15 liters per minute and at pressures sufficient to overcome internal pressure within the emulsifier apparatus caused by the inflow of compressed air through the compressed air inlet;

increasing the pressure of compressed air supplied to the emulsifier apparatus through the compressed air inlet with a corresponding increase in the pressure of foaming solution supplied to the foaming solution inlet until sufficient pressure is generated to force foam exiting the foam outlet along the discharge conduit and down the gas well with an average density of approximately 1 KPA per meter, while monitoring gas well pressure and varying compressed air pressure and foam density to ensure that pressure is always maintained at less than 80% of well pressure.

2. The method as defined in claim 1, the emulsifier apparatus operating without the application of heat.

3. The method as defined in claim 1, the emulsifier apparatus having a series of axially spaced mixing plates having holes, the holes in adjacent mixing plates being axially offset.

* * * * *